United States Patent [19]

Schmutzer et al.

[11] 4,132,925

[45] Jan. 2, 1979

[54] DIRECT CURRENT BALLASTING AND STARTING CIRCUITRY FOR GASEOUS DISCHARGE LAMPS

[75] Inventors: Joel J. Schmutzer, Oak Park, Ill.; George D. Elkerton, Edmonds, Wash.

[73] Assignee: Forest Electric Company, Melrose Park, Ill.

[21] Appl. No.: 696,400

[22] Filed: Jun. 15, 1976

[51] Int. Cl.[2] ..... H05B 41/36; H05B 41/16

[52] U.S. Cl. ..... 315/208; 315/224; 315/228; 315/240; 315/290; 315/307; 315/324; 315/DIG. 7

[58] Field of Search ..... 315/200 R, 208, 209 R, 315/224, 289, 290, 291, 307, DIG. 5, DIG. 7, 228, 240, 312, 313, 324

[56] References Cited

U.S. PATENT DOCUMENTS

| | | | |
|---|---|---|---|
| 3,265,930 | 8/1966 | Powell, Jr. | 315/224 X |
| 3,626,277 | 12/1971 | Munson | 315/224 X |
| 3,890,537 | 6/1975 | Park et al. | 315/208 |
| 4,045,709 | 8/1977 | Morais | 315/208 X |

*Primary Examiner*—Eugene R. LaRoche
*Attorney, Agent, or Firm*—McWilliams & Mann

[57] ABSTRACT

Direct current ballasting and starting circuitry for efficiently operating a gaseous discharge lamp on direct current. A series-pass switching transistor in one of a pair of input lines alternately switches between on and off states to periodically supply pulses of energy from a source of direct current voltage. During steady-state operation, current sensing circuitry limits the maximum current conductable by the transistor such that the output of the circuitry is current regulated. A filter, in series with the transistor, smoothes the pulses of energy delivered by the transistor into direct current with a comparatively small alternating current component. Starting circuitry in series connection between the filter and an output terminal, senses the nonionized state of the lamp and provides a voltage pulse of sufficient magnitude and duration to initiate ionization in the lamp, but permits uninterfered passage of current through the filter to the output. Various forms of control or drive circuitry for controlling the conductive state of the transistor are disclosed, including a phase-corrected oscillator which is momentarily excited by a starting pulse delivered at the output terminal and oscillation is thereafter sustained by interaction with the transistor a resonant transformer capacitor circuit with a secondary winding of the transformer controlling the transistor; and a pulse-width modulation drive. Various starting circuits are disclosed, including a single starting circuit for sensing the nonionized state of any of a plurality of lamps.

18 Claims, 7 Drawing Figures

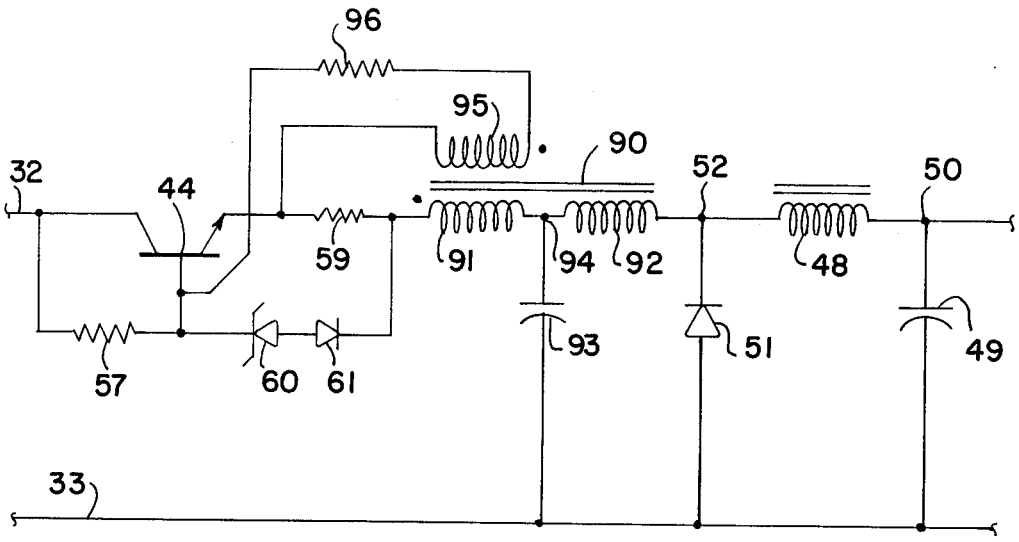
FIG. 4
FIG. 5
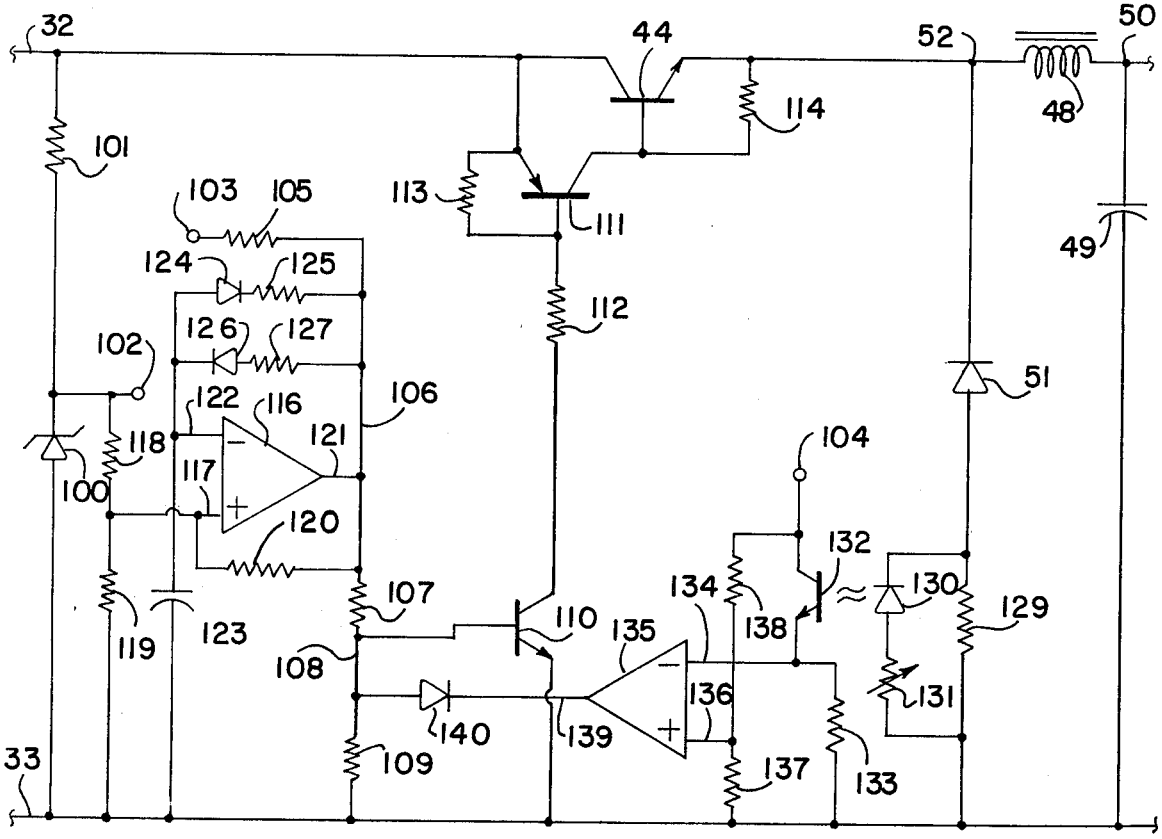

DIRECT CURRENT BALLASTING AND STARTING CIRCUITRY FOR GASEOUS DISCHARGE LAMPS

BACKGROUND OF THE INVENTION

This invention relates in general to ballasting and starting circuitry for operating gaseous discharge lamps from D.C., and more particularly to such circuitry with a current-regulated output characteristic wherein series-pass switching means is alternatively switched between on and off conductive states and to A.C. and D.C. power conversion circuits for supplying direct current to a plurality of ballasting and starting circuits.

At the present time, use of A.C. power sources to power gaseous discharge tubes, especially those used in fluorescent lighting, by far exceed the use of D.C. power sources. This is not particularly surprising because A.C. power sources are usually more readily available than D.C. power sources. However, operation of fluorescent lamps from A.C. power sources has a number of disadvantages. One of these problems is that fluorescent lamps generate and radiate radio frequency interference (RFI). RFI is a form of electro-magnetic radiation, which among other things is known for interferring with the performance of communications systems, e.g. radio and television. The RFI is generated because, as the A.C. changes or reverses polarity during a portion of each cycle, the arc between the electrodes of the gaseous discharge tube extinguishes. The tube must then be restarted for current flow in the opposite direction and much of the RFI is generated when the arc between the electrodes of the gaseous discharge tube begins to restrike.

The constant polarity reversal of voltage and current in an A.C. power source also requires that heating be provided at both electrodes of the gaseous discharge tube. To condition a gaseous discharge tube for the striking of an arc between the electrodes, it is necessary to heat the cathodic electrode to facilitate electron emission. However, in an A.C. system, the electrode of the tube which is the cathodic electrode is constantly changing as the polarity of the voltage and current change. This necessitates the heating of both terminals.

Because the arc between the terminals of the gaseous discharge tube operating from an A.C. power source is constantly being extinguished and then reignited, lighting from a fluorescent lamp is not continuous. Instead, the lamp actually flickers. This flickering phenomenom is not noticeable to the unaided eye because the frequency of most A.C. power sources is somewhat above a frequency level which is perceptible. Nonetheless, recent behavorial and physiological studies have indicated that the inherent flickering has undesireable side-effects. Behavior and activity of children tending to be hyperactive are believed to be aggravated by the flickering. The flickering is also believed to hasten fatigue, which is a serious problem to medical personnel when attempting to differentiate between the various shadings of x-ray films.

The flickering phenomenom further causes stroboscopic effects when any movement is related to a harmonic of the A.C. power source frequency. This can present a safety hazard because the stroboscopic effects cause rotating machinery to appear to be either stationary or slowly rotating.

Even when operating from an A.C. power source, fluorescent lamps require circuitry to power and control the lamp because of the unusual load characteristics of gaseous discharge tubes. To achieve arcing between the electrodes of a gaseous discharge tube, the striking voltage of the tube must be exceeded. The striking voltage is often twice the voltage at which the tube will operate once striking of the arc between the terminals of the tube occurs. Circuitry must be provided to generate a voltage pulse of sufficient magnitude and duration to achieve striking. However, when striking of the arc occurs, current to the tube must then be limited. The current limiting function is often provided in A.C. circuits by a high leakage reactance transformer, which may constitute the bulk of the weight and expense in a fluorescent system. Gaseous discharge tubes are not susceptible to voltage regulation once arcing between the electrodes thereof is initiated because of the negative impedance characteristic of the tube. The tube will conduct an excessive amount of current to the point of self-destruction. Therefore the current to a fluorescent lamp must be limited and the particular load characteristic of the lamp will determine the voltage at which it operates at a regulated current level. For a given current, the operating voltage of the tube is a function of the length of the tube, its diameter, the types of gases within the tube and a number of other factors.

Some prior art efforts have been concerned with operating gaseous discharge tubes in conjunction with D.C. ballasting and starting circuits. These efforts have been generally centered around biasing a series pass semiconductor, usually a transistor, such that the current therethrough is limited to the desired current through the gaseous discharge tube. To compensate for a number of variables in such circuit design and the expected variations in the D.C. power source, a relatively large voltage is usually dropped across the series pass transistor. Hence, the series-pass transistor must dissipate a significant amount of power. This power is wasted energy and leads to a low efficiency of operation for the circuit. The power dissipation also requires the use of larger and more expensive semiconductors for the series-pass element. This further requires a heat sink to dissipate the heat from the transistor, and some instances, forced air ventilation thereof. Thus, such prior art ballasting and starting circuits have not met with much acceptance or commercial success, except in quite limited or specialized applications.

SUMMARY OF THE INVENTION

The direct current ballasting and starting circuitry of the present invention employs a series-pass switching means in one of a pair of input lines. The circuit provides a regulated output current. The switching means or semiconductor is alternately switched between on and off conductive states. During the off state, no current is conducted through the series-pass semiconductor and during the on stage the voltage drop thereacross is very small. The power lost in the series-pass semiconductor is very minimal. Thus there is no need for massive heat sinks or for large semiconductors capable of withstanding and dissipating higher power losses, as in the prior art circuits. Means of limiting the current conducted by the switching means is accomplished by current sensing means in series connection with switching means. Filtering means are in series with the current sensing means for smoothing pulses of energy delivered by the switching means for the D.C voltage source. The filter means has a direct current output with a comparatively small alternating current component thereon.

The starting circuitry is in series connection between the filter means and an output terminal of the circuity for sensing the nonionized condition of a lamp connectible to the output terminal. The starting circuitry further provides a voltage pulse of sufficient magnitude and duration to initiate ionization within the lamp. Once ionization is achieved, the starting circuit becomes inactive and does not impede the supply of direct current from the filter means to the lamp.

Various means for controlling the on and off conductive states of the series-pass switching semiconductor may be utilized. In one embodiment, an oscillator is momentarily responsive to excitation provided by the starting voltage pulse at one of the output terminals and thereafter interacts with the switching means. The oscillator has a resonant tank circuit for controlling the series pass semiconductor and the tank circuit is also phase-corrected to provide the series pass semiconductor with a 70 percent duty cycle to insure that sufficient power is available from the circuit.

Another embodiment of the control means utilizes a free-running multivibrator, the output of which is pulse-width modulated to control the on-off states of the series-pass semiconductor.

Where a plurality of ballasting and starting circuits are used, a single starting circuit may be used to generate the striking voltage pulses for all of the ballasting circuits. Secondary windings of pulse transformers are in series connection with an output line of each ballasting circuit. Primary windings are connected in series between an energy storage means and a voltage responsive means. A diode from the output line of each ballasting circuit is poled in a logic "or" configuration such a nonionized condition in any lamp associate with its ballasting circuit will charge the energy storge means to a voltage level which will render the voltage responsive means conductive, thereby discharging the energy storage means through the primary windings of the pulse transformers and starting the desired lamp.

A power conversion circuit for converting A.C. voltage to a suitable D.C. voltage for operation of the ballasting and starting circuitry is also disclosed. A portion of a primary winding of a transformer is tapped for applying the A.C. voltage source thereacross. The entire primary winding is applied to rectification means for rectifying the A.C. voltage and supplying the same to a filter means. The filter means supplies an elevated D.C. voltage level to a plurality of D.C. ballasting and starting circuits. A secondary winding of the transformer supplies a considerably lower A.C. voltage level to the cathodic electrode of the lamp associated with each ballasting and starting circuit for heating the same. The secondary winding of the transformer is center-tapped, with the center-tap referenced to a second of the input lines of the ballasting and starting circuitry. Thus the cathode of each lamp is heated with a small A.C. voltage which is balanced with respect to the second input line thereby eliminating A.C. modulation of the D.C. current supplied to each lamp.

Various other objects, features and advantages of the invention will become apparent from the following detailed disclosure when taken in conjunction with the drawings.

BRIEF DESCRIPTION OF THE DRAWINGS

In the drawings:

FIG. 4 is a schematic circuit diagram of a D.C. ballasting circuit with an alternative embodiment of controlling the conductive state of a series-pass semiconductor;

FIG. 5 is a schematic circuit diagram of an alternate pulse-width modulation technique for controlling the conductive state of the series-pass semiconductor;

DESCRIPTION OF THE PREFERRED EMBODIMENTS

Figure 1:
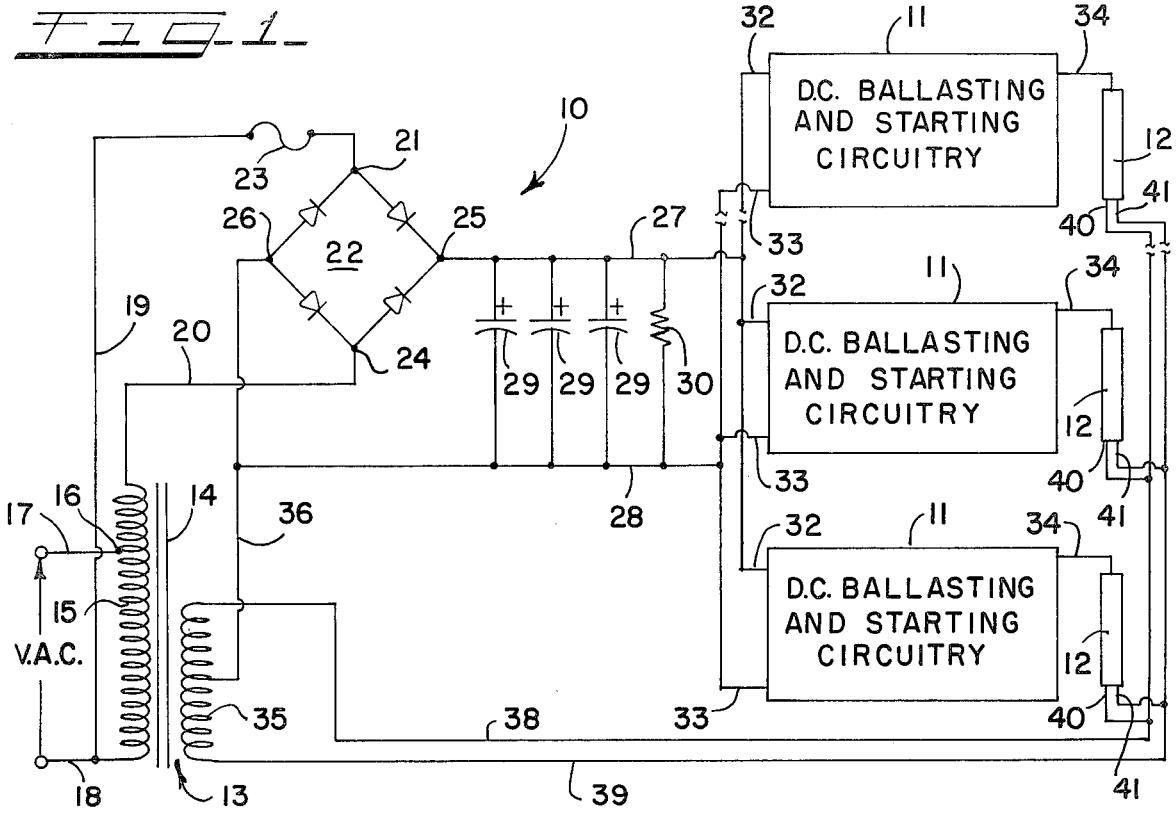
FIG. 1 is a schematic diagram of the A.C. to D.C. power conversion circuit for supplying D.C. power to a plurality of ballasting and starting circuits, each of which supplies regulated direct current to a gaseous discharge tube.

Referring to FIG. 1, there is shown an A.C. to D.C. power conversion circuit, generally designated as 10. A single circuit 10 is capable of supplying D.C. power of a suitable voltage level to a plurality of D.C. ballasting and starting circuits 11. As will be hereinafter presented, the ballasting and starting circuit 11 supplies regulated current to at least one gaseous discharge tube or fluorescent lamp 12.

The power conversion circuit 10 has a power transformer, generally designated as 13, with a core 14 of iron or other suitable magnetic material. A primary winding 15 of the transformer 13 has a tap, at a point 16. A pair of leads 17, 18, one of which is connected to the tap at point 16, supply voltage from an A.C. power source to a portion of the primary winding 15.

A pair of leads 19, 20 interconnect opposite ends of the primary winding 15 to opposite terminals 21, 24 of a rectification means, i.e. a diode rectification bridge 22. A fuse 23, in series with the lead 19, protects the circuit 10 and the circuits 11 from overload or malfunction which could result in excessive current demand.

To minimize the amount of filtering required to filter the rectified A.C. voltage, the diode bridge 22 is preferably of the full-wave type. The diodes in the bridge 22 are poled to provide a positive D.C. potential at a terminal 25 with respect to a common terminal 26. The potential between the terminals 25, 26 will typically be in the range of 145 to 190 volts D.C. Connected in parallel across a pair of leads 27, 28, which are respectively connected to the terminals 25, 26, is at least one capacitor 29 for filtering the rectified A.C. voltage from the bridge 22. Because of the magnitude of D.C. voltage between the leads 27, 28, it may be more economical to provide a plurality of capacitors 29.

A bleeder resistor 30 is usually provided in parallel with the capacitors 29 to reduce the voltage across the leads 27, 28 within a specified period of time after A.C. voltage has been removed from the leads 17, 18. The phosphor coating in some fluorescent lamps 12 will continue to fluoresce at a reduced level of illumination until the voltage across the lamp 12 is insufficient to maintain arcing between an anodic electrode (not shown) and cathodic electrode (not shown) of the lamp 12. The bleeder resistor 30 insures that within a specified period of time the voltage levels within the circuit 10 and hence the circuit 11 will be reduced to a level at which the fluorescent phenomenom will terminate.

The positive D.C. voltage lead 27 is connected to an input line 32 of each of the ballasting and starting circuits 11. The common lead 28 is similarly connected to a second input line 33 of the circuits 11. An output terminal 34 of each of the circuits 11 provides suitable power, sensing and controlling functions to power and control at least one fluorescent lamp 12 of the circuits 11, as is hereinafter described.

The power transformer 13 also has a secondary winding 35 with an A.C. voltage thereacross which is considerably lower in magnitude than that across the primary winding 15. The secondary winding 35 is center-tapped and connected by a lead 36 to the common line 28 of the circuit 10 and to the terminal 26 of the diode bridge 22. A pair of leads 38, 39 are connected to opposite ends of the secondary winding 35 and to terminals 40, 41 to heat the cathodic electrode within the lamp 12 to provide electron emission therefrom. Because the secondary winding 35 is center-tapped and referenced by a lead 36 to the common line 28, the average voltage on the cathodic electrode of any lamp 12 will be zero. Thus, A.C. voltage modulation of the potential across any lamp 12 is minimized or eliminated. Use of a center-tapped secondary winding 35 avoids the need for supplying a small D.C. voltage for heating the cathodic electrode in the lamps 12, which would require additional components such as rectifying diodes and filtering capacitors to eliminate ripple.

The secondary winding 35, while providing an A.C. voltage for heating the tube 12 also forms part of the return path for the D.C. current for the lamps 12. D.C. current supplied by the ballasting and starting circuitry 11 at the output terminal 34 flows through the tube 12 and returns to the power conversion circuit 10 through both of the leads 38, 39, the secondary winding 35, and the lead 36 to the terminal 26 of the diode bridge 22.

As previously noted, in operating fluorescent lamps 12 from an A.C. power source, both ends of the lamp 12 must be heated because the cathodic electrode in the lamp 12 changes as the polarity of the voltage and current in the lamp 12 reverse. However, in operating a lamp 12 from a D.C. power source, the polarity of the voltage and current applied to the lamp 12 remains constant. Thus, only the end of the lamp 12 which is to be the cathodic end needs to be heated. As illustrated in FIG. 1, the output terminal 34 of the ballasting and starting circuit 11 need only be applied to one terminal on the anodic end of the lamp 12 to provide electrical connection thereto.

Figure 2:
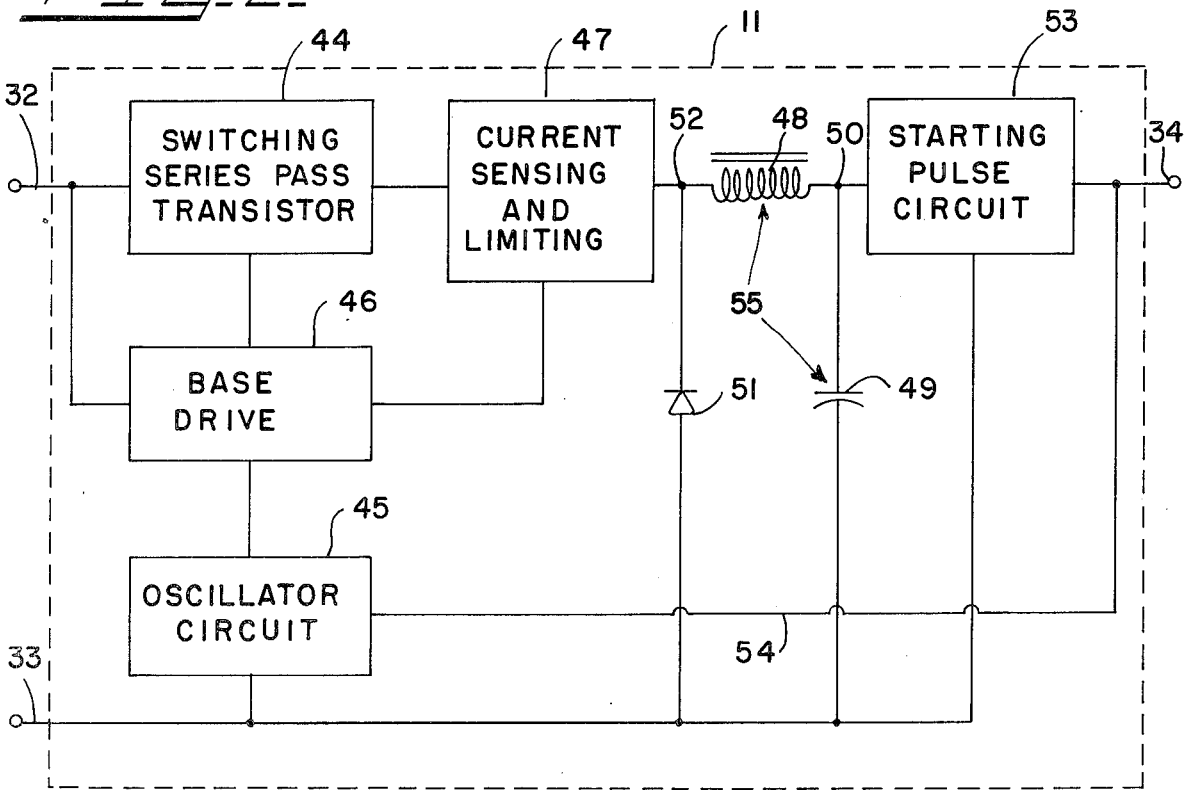
FIG. 2 is a schematic circuit diagram, mostly in block form, of a D.C. ballasting and starting circuit as illustrated in FIG. 1.

Turning now to FIG. 2, there is shown a circuit diagram, mostly in block form, of one of the D.C. ballasting and starting circuits 11 of FIG. 1. A pair of input lines 32, 33 supplies a source of D.C. voltage to the circuit 11. An output terminal 34 supplies power to the gaseous discharge tube 12, and controls and senses the condition of the gaseous discharge tube. In series with one of the input lines 32 is switching means in the form of a switching series-pass transistor 44. The switching transistor 44 is alternately switchable between on and off conductive states for periodically supplying pulses of energy from the sources of D.C. voltage. An oscillator circuit 45 in combination with base drive 46 provides a means of controlling the conductive state of switching transistor 44. Current sensing means 47 limits the maximum current through the transistor 44. One means of limiting current through the transistor 44 is by diverting the base drive 46 therefrom, to immediately switch the transistor 44 to an off conductive state. Filter means 55 includes an inductor 48 and a capacitor 49. The inductor 48 receives pulses of energy from the switching transistor 44 and in combination with the capacitor 49 filters the pulses of energy into direct current with a small alternating current component, in the form of ripple, superimposed on the direct current at a junction 50. The capacitor 49 is connected between the junction 50 and the second input line 33. A commutating diode 51 is connected between the second input 33 and a junction 52 with the diode 51 poled to maintain current continuity in the inductor 48 when the switching transistor 44 is in an off conductive state.

A starting pulse circuit 53 is biassed between the output terminal 34 and the second input 33. Because the ballasting and starting circuit 11 does not regulate voltage at the output terminal 34, but only regulates current deliverable thereto, the potential at the output terminal 34 will rise to a level similar to that at the input line 32 when the circuit 11 is first energized. The starting pulse circuit 53 senses this higher voltage level as indicative of a nonionized or nonconductive condition of a lamp connectible to the output terminal 34 and thereupon generates a voltage pulse of sufficient magnitude and duration to initiate ionization in a gaseous discharge lamp. Once striking of the arc within the lamp has occurred, the voltage at the output terminal 34 drops and the output voltage is controlled and determined by the load characteristics of the particular gaseous discharge tube connected thereto. The circuit 11 will then begin operating in a current-regulated output mode. As the potential at the terminal 34 drops, the starting pulse circuit 53 will become inactive. However, should some occurrence cause a loss of arcing within the lamp, the above starting process will automatically repeat.

The oscillator 45 is connected by a lead 54 to the output terminal 34 such that the starting voltge pulse initially excites the oscillator 45, and thereafter the oscillator 45 interacts within the transistor 44 to remain in an oscillatory condition. The oscillator circuit 45 alternately aids and opposes the base drive 46 to the switching series-pass transistor 44, thereby alternately switching the transistor 44 between on and off conductive states.

Figure 3:
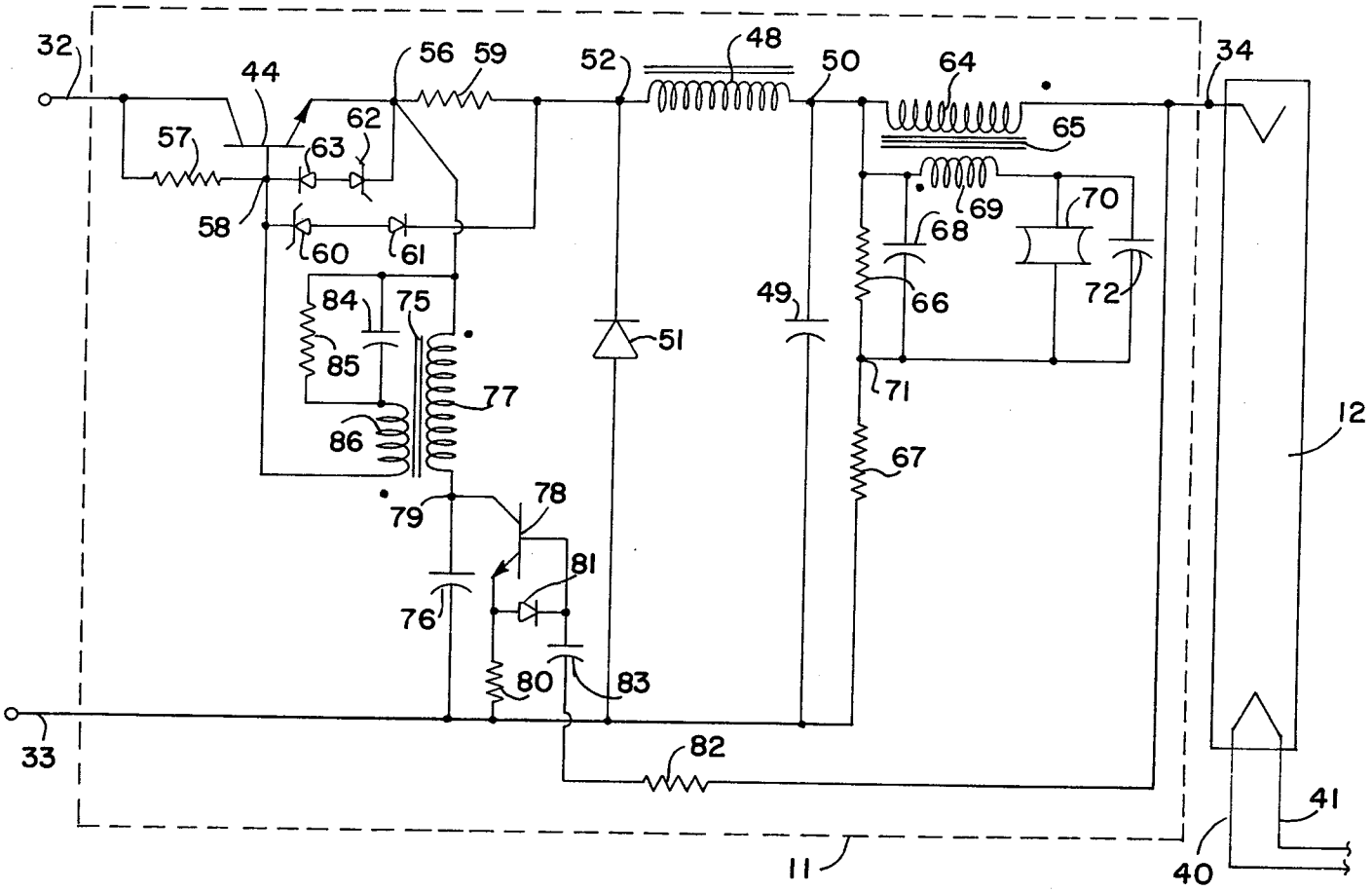
FIG. 3 is a schematic circuit diagram of the preferred embodiment of a D.C. ballasting and starting circuit for supplying power to a gaseous discharge tube.

FIG. 3 illustrates the preferred embodiment of the D.C. ballasting and starting circuit 11 of FIGS. 1 and 2. A series-pass switching transistor 44, of the NPN type, is connected in series between the input line 32 and a junction 56. The collector terminal of the transistor 44 is connected to the junction 56. A resistor 57 is connected from the input line 32 to a junction 58. The base terminal of the transistor 44 is also connected to the junction 58 such that the transistor receives base drive from the resistor 58 to normally bias the transistor 44 in an on conductive state.

Connected in series between the junctions 52, 56 is a resistor 59, of low ohmic value, for sensing the current delivered by the transistor 44. A series combination of a zener diode 60 and a rectifying diode 61 are connected between the junction 52 and the junction 58. The zener diode 60 has its cathode terminal connected to the junction 58 while the rectifying diode 61 has its cathode terminal at the junction 52. When the current through the current sensing resistor 59 establishes a potential thereacross which exceeds the zener voltage of the zener diode 60, the zener diode 60 begins conduction and diverts base current drive delivered by the resistor 57 and by an oscillator winding 86 away from the base of the transistor 44. The diode 61 compensates for both the potential drop by the forward-biassed base-emitter junction of the transistor 44 and also for temperature variation thereof. Thus, the combination of the resistor 59, the zener diode 60 and the rectifying diode 61, limits the maximum current which the switching transistor 44 may conduct. In fact, in steady-state operation of the circuit 11, the switching transistor 44 is repeatedly switched to the off conductive state upon reaching a predetermined current level. The transistor 44 however receives sufficient base drive that it operates near the saturation region before delivering the limited current. Thus, although the transistor 44 delivers significant power to the junction 56 during its on conductive states, because of the low collector to emitter drop across the transistor 44, power dissipation in the transistor 44 is minimal. Of course, during off conductive states of the transistor 44, no current is conducted therethrough and no power dissipation therein occurs.

A series combination of another zener diode 62 and another rectifying diode 63 are connected between the junctions 56, 58 across the base-emitter junction of the transistor 44. The zener diode 62 has its cathode terminal connected to the emitter of the transistor 44 while the rectifying diode has its cathode terminal connected to the base of the transistor 44. The diodes 62, 63 prevent reverse voltage breakdown of the base-emitter junction of the transistor 44 due to signals applied to the base of the transistor 44 by the oscillator circuit. The zener diode 62 also reduces oscillator loading during off conductive states of the transistor 44.

An inductor 48 is connected in series with the current sensing resistor 59 between the junctions 52 and 50. A capacitor 49 is connected between the junction 50 and the second input line 33. The combination of the series inductor 48 and the parallel capacitor 49 comprise a filter to smooth the pulses of energy delivered by the switching transistor 44 at the junction 52. The voltage at the junction 50 is primarily D.C. with a small amount of ripple superimposed thereon. The small voltage ripple at the point 50 is due to the fact that the filter comprised of the inductor 48 and the capacitor 49 is not an ideal filter.

Connected between the junction 52 on the opposite side of the inductor 48 and the second input lead 33 is a commutating diode 51. The commutating diode 51 has its cathode terminal connected to the junction 52. Continuity of current through the inductor 48 during the off conductive state of the transistor 44 is provided by the commutating diode 51. However, during the on conductive state of the transistor 44 the commutating diode 51 is reverse-biassed and non-conductive.

Due to considerations of power efficiency and rapid switching, as are more fully discussed hereinafter, the commutating diode 51 must have fast recovery times when switching between conductive states. A suitable diode is commercially available from Varo, Inc., Garland, Tex. 74040, as part number V334X and has 3 ampere, 400 volt ratings.

Connected in series between the junction 50 and the output terminal 34 is a secondary winding 64 of a pulse transformer 65. The secondary winding 64 does not interfere with passage of direct current therethrough to the lamp 12. However, the secondary winding 64 is capable of delivering a starting pulse of sufficient magnitude and duration which, when added to the potential already at the junction 50, provides a sufficient potential at the output terminal 34 to initiate ionization and the striking of an arc between the electrodes of the lamp 12. The starting circuit further has a pair of voltage dividing resistors 66 and 67 connected between the junction 50 and the second input line 33. Energy storage means in the form of a capacitor 68 is connected in parallel with the resistor 66. A primary winding 69 of the pulse transformer 65 has one end connected to the junction 50. Another end of the primary winding 69 is connected through a spark gap 70 to another junction 71 between the voltage dividing resistors 66 and 67. Connected in parallel across the spark gap 70 is a second capacitor 72 which is of greater capacitance than the energy storage capacitor 68. The spark gap 70 is a voltage threshold sensitive device, which is nonconductive for voltages across the resistor 66 which are below its threshold voltage. Upon exceeding its threshold voltage, the spark gap 70 assumes a very low impedance characteristic if provided with sufficient current during initial conduction. The capacitor 72 initially provides sufficient current to insure that the spark gap 70 assumes a low impedance condition to completely discharge the energy storage capacitor 68 through the primary winding 60 of the pulse transformer 65, thereby generating a starting pulse across the secondary winding 64. After discharging the capacitor 68 to a low voltage level, the arcing in the spark gap 70 will extinguish whereupon the spark gap 70 will resume its high impedance, nonconductive state. A suitable spark gap 70 with a threshold voltage level of approximately 90 volts is commercially available from the Siemens Corp, Iselin, N.J. 08830, as part number BI-F90.

If the starting pulse generated across the secondary winding 64 is unsuccessful in striking an arc in the lamp 12, the voltage at a junction 50 will nearly equal that at the input lead 32. The energy storge capacitor 68 will again recharge in approximately one second to the point at which the voltage thereacross exceeds the threshold voltage of the spark gap 70. Thus the starting circuit will continue to generate starting pulses until ionization is established in the lamp 12. Unless the lamp 12 is defective or some other circuit malfunction is present, the starting circuit will usually energize the lamp 12 when the first starting pulse is generated. When arcing in lamp 12 commences, the D.C. potential at the junction 50 and at the output terminal 34 will drop to a potential which is determined by the load characteristics of the lamp 12. That is, the ballasting and starting circuit 11 begins to operate in a current-regulated output mode.

The means for controlling the on and off states of the series-pass transistor 44 is provided by an oscillator circuit. As shown in FIG. 3, the oscillator circuit has a resonant tank circuit consisting of a transformer 75 and a capacitor 76. A primary winding 77 of the transformer 75 is connected in series with the capacitor 76 between the junction 56 and the second input line 33. A transistor 78 momentarily excites the resonant tank circuit when the starting pulse is generated at the output terminal 34. Thereafter, the tank circuit interacts with the transistor 44 to remain in a self-oscillating condition. The transistor 78 has a collector terminal connected to a junction 79 between the primary winding 77 and the capacitor 76. An emitter terminal of the transistor 78 is referenced to the second input line 33 through a resistor 80. A diode 81 is connected between the emitter and base terminals of the transistor 78, with the cathode of the diode 81 connected to the base of the transistor 78, to prevent reverse voltage breakdown of the base-emitter junction of the transistor 78 and to recharge a capacitor 83 through the resistor 80 to prepare the circuit for a subsequent starting pulse, if necessary. A series combination of a resistor 82 and a capacitor 83 are connected between the base of the transistor 78 and the output terminal 34. The oscillator circuit is thus insensitive to the D.C. level at the output terminal 34, but is instantaneously excited when the starting voltage pulse appears at the output terminal 34. The transistor 78 momentarily conducts current through winding 77 thereby generating base drive for the transistor 44 across the winding 86. Resistor 80 limits peak current conducted through the winding 77. Transistor 78 only conducts during the starting pulse which, however, has the after-effect of causing the resonant tank circuit to ring for a sufficient number of cycles to cause transistor 44 to begin self-oscillating at the natural resonant frequency of the tank circuit including winding 77 and capacitor 76. A parallel combination of a capacitor 84 and a resistor 85 are connected in series with a secondary winding 86 of the resonant transformer 75, which is in turn connected across the base and emitter terminals of the series-pass switching transistor 44. The secondary winding 86 applies the oscillator output signal across the base-emitter junction of a series-pass switching transistor 44, thereby alternately driving the transistor 44 into an on conductive state. When the level of the transistor output signal across the secondary winding 86 rises, the oscillator will reverse bias the base-emitter junction of the transistor 44 which will cause the transistor 44 to assume an off conductive state. At the same time, the secondary winding 86 will conduct any base drive through the resistor 57 away from the transistor 44.

A parallel combination of the capacitor 84 and the resistor 85 provide an R-C phase-shifting network in series with the secondary winding 86. The R-C network phase compensates the oscillator output signal for phase-shifts caused by other circuit components, and under normal operating conditions produces 70 percent on period and 30 percent off period for the switching transistor 44.

The resonant frequency of the oscillator circuit will determine the frequency at which the switching resistor 44 operates. Higher operating frequencies are preferred because the inductor 48 may be of less inductance and the capacitor 49 of less capacitance and still maintain the peak-to-peak ripple voltage appearing at the output terminal 34 below permissible levels. Lower inductive and capacitive values mean that the inductor 48 and the capacitor 49 of the filter means will be of smaller physical size and usually of a lower cost. However, limitation on the maximum frequency which the oscillator should operate is imposed by power loss considerations in the switching transistor 44 and in the commutating diode 51. As previously noted, very little power dissipation occurs in the series-pass transistor 44 when the transistor 44 is in an on conductive state because it is operating in the saturation region, i.e. a very low collector to emitter voltage drop. No power dissipation occurs in the series-pass transistor 44 when it is in an off conductive state, because there is no current passing therethrough. Similarly, the commutating diode 41 experiences no power dissipation when in an off conductive mode, and very little power dissipation when in an on conductive mode because the voltage drop thereacross is only that of a forward-biassed diode junction.

However, both the transistor 44 and the diode 51 have finite turn-on and turn-off time periods. When the operating frequency of the circuit becomes high enough that the turn-on and turn-off times of the transistor 44 and the diode 51 become an appreciable portion of the time period associated with the operating frequency, the power losses in both the transistor 44 and the diode 51 also become appreciable. A suitable operating frequency at which the size and cost of the inductor 48 and the capacitor 49 are minimized but which is also low enough to avoid appreciable switching losses in the transistor 44 and in the diode 51 is in the vicinity of 20 kiloHertz.

Various other forms of control and drive means for the series-pass switching transistor 44 will become apparent to those skilled in the art besides the oscillator circuit illustrated in FIG. 3. Shown in FIG. 4 is a resonant circuit of the tuned-T configuration which is interposed between the current sensing resistor 59 and the junction 52, at which the commutating diode 51 is connected to one side of the inductor 48. A resonant transformer 90 has a pair of primary windings 91, 92 connected in series between the current sensing resistor 59 and the junction 52. A capacitor 93 is connected to a junction 94 between the two windings 91, 92 and to the second input line 33. A secondary winding 95 of the transformer 90 is connected in series with a resistor 96 across the base and emitter terminals of the transistor 44. The resistor 96 limits the amount of current deliverable by the secondary winding 95 to the transistor 44. As the polarity markings associated with the windings 91, 95 would indicate, the secondary winding 95 provides more drive for the transistor 44 when the transistor 44 begins to assume an on conductive state.

At a later time during the on conductive state, when current through the primary windings 91, 92 begins to decrease, the secondary winding in 95 will experience a voltage reversal which will reverse bias the base-emitter junction of the transistor 44, thereby switching the transistor 44 to an off conductive state. At the same time, base drive for the transistor 44 through the resistor 57 will be diverted through the secondary winding 95. Thus, the time periods of the on and off conductive states of the series-pass transistor 44 will be determined by the frequency of the tuned resonant circuit comprising the transformer 90 and the capacitor 93. Otherwise, operation of the circuit in FIG. 4 is similar to that in FIG. 3. It is, of course, realized that the circuit in FIG. 4 will require a starting circuit for initiating ionization in a gaseous discharge lamp. The starting circuit will be connected across a junction 50 and the second input line 33 in a manner similar to the circuitry in FIG. 3.

A pulse-width modulation technique for controlling and driving the series-pass transistor 44 is illustrated in FIG. 5. A zener diode 100 has an anode terminal connected to the second input line 33 and a cathode terminal connected through a resistor 101 to the first input line 32. The zener diode 100 provides both reference voltages and biasing voltages at a terminal 102 which is connected to the cathode terminal of the zener diode 100. The terminal 102 is electrically the same as other terminals 103 and 104.

Terminal 103 is referenced to the second input line 33 through the series combination of a resistor 105, a lead 106, a resistor 107, a lead 108, and a resistor 109. A base terminal of a transistor 110, which is of the NPN type, is connected to the lead 108. An emitter terminal of the transistor 110 is referenced to the second input line 33.

A collector terminal of the transistor 110 is connected to a base terminal of a PNP transistor 111 through a resistor 112. The transistor 111 has an emitter terminal connected to the first input line 32 and a collector terminal connected to the base of the series transistor 44. A resistor 113, connected across the base-emitter junction of the transistor 111 provides a path for collector leakage currents of the transistor 110. Similarly, a resistor 114 connected across the base-emitter junction of the series-pass transistor 44 provides a path for collector leakage currents from the transistor 111.

The resistors 105, 107, 109 normally bias the transistor 110 into a nonconductive state which further causes the transistors 111 and 44 to also assume on conductive states.

However, shortly after the ballasting circuit in FIG. 5 is turned on, a free-running multivibrator will begin periodically switching the transistors 110, 113, 44 to an off conductive state. An amplifier 116 has a non-inverting input 117 connected to a reference voltage supplied by a pair of voltage dividing resistors 118, 119. The resistors 118, 119 are connected in series between the reference voltage supplied by the zener diode 100 at the terminal 102 and the second input line 33. A feedback resistor 120, connected between the non-inverting input 117 and an output 121 of the amplifier 116 is selected to fix the gain of the amplifier circuit. The output 121 of the amplifier 116 is connected to the lead 106 and is therefore capable of controlling bias voltage supplied by the resistors 105, 107, 109 to the base of the transistor 110 to control the conductive state thereof. An inverting input 122 of the amplifier 116 is referenced to the second input line 33 through a capacitor 123. The inverting input 122 is also connected to the output 121 through the series combination diode 124 and a resistor 125, and through another series combination of another diode 126 and another resistor 127. The diode 124 and 126 are poled in opposite directions with the anode terminal of the diode 124 connected to the input 122 and the cathode of the diode 126 connected to the input 122.

Operation of the free-running multivibrator is as follows. When the ballasting circuit in FIG. 5 is first energized across the input leads 32, 33, the reference voltage applied to the non-inverting input 117 by the voltage dividing resistors 118, 119 causes the output of the amplifier to assume a high output condition which enables the biasing resistors 105, 107, 109 to bias the transistors 110, 111, 44 into on conductive states. At the same time, the capacitor 123 connected to the inverting input 122 of the amplifier 116 begins to charge through the resistor 127 and the diode 126. The diode 124, being reverse biased, is nonconductive. At some later time, a voltage across the capacitor 123 will begin to exceed the reference voltage at the non-inverting input 117, thereby causing the amplifier 116 to assume a low voltage output condition at the output 121. When the output 121 of the amplifier 116 assumes a low output condition, the transistor 110 loses its bias and assumes an off conductive state, thereby also causing transistors 111, 44 to assume off conductive states. The low output of the amplifier 116 also causes the voltage across the capacitor 123 to exceed voltage at the output 121. Thus, the capacitor 123 begins discharging into the output 121 of the amplifier 116 through the diode 124 and the resistor 125. Diode 126 is now reverse-biased and therefore nonconductive. The capacitor 123 will continue to discharge until the voltage at the inverting input 122 is less than that of the non-inverting input 117, at which time, the output 121 of the amplifier 116 will again assume a high voltage condition.

It will be readily appreciated that the timing of the high and low voltage conditions at the output 121 can be controlled by selection of the resistors 125 and 127. For instance, if the resistive value of the resistor 127 exceeds that of the resistor 125, the capacitor 123 will take a longer time period in which to charge than the time period in which the capacitor 123 will discharge through the resistor 125. Thus, the duty cycle, defined as the ratio of the time in which the output 121 will remain at a high voltage condition to the sum of the time periods of the high and low voltage conditions at the output 121, may be controlled depending upon the selection of the resistors 125, 127. Since the output 121 directly controls the conductive state of the series-pass switching transistor 44, the duty cycle of the multivibrator circuit directly correlates to the duty cycle of the series-pass transistor 44. To ensure that sufficient energy is delivered to the load by the series-pass transistor 44, a duty cycle for the multivibrator circuit of approximately 70 percent is preferred.

However, with a duty cycle in the vicinity of 70 percent, the series-pass transistor 44 may deliver more energy than is desirable and therefore some means of controlling or overriding the output of the multivibrator circuit is desired. To this end, the resistor 129, a low ohmic value, is placed in series with the commutating diode 51 to sense the current level therethrough. As previously presented, the commutating diode 51 maintains continuity of current through the inductor 48 when the series transistor 44 assumes a nonconductive state. During steady state of operation of the ballasting circuit, the current of level through the inductor 48 will remain constant from cycle to cycle during any instant thereof. Thus, current through the commutating diode, while the transistor 44 is off, is directly related to current through the transistor 44 when the transistor 44 is in a conductive state. Therefore, current sensing means may be placed in series with the commutating diode 51 instead of in series with the series-pass switching transistor 44 as is done in FIGS. 3 and 4.

Current threshold detecting means is used to sense current levels in the commutating diode 51 above a predetermined threshold. A light emitting diode 130 is connected in series with an adjustable resistor 131 across the current resistor 129. The light emitting diode 130 is placed in close proximity to a photosensitive transistor 132 such that light from the diode 130 is detected by the photosensitive transistor 132.

The electrical isolation of the diode 130 from the transistor 132 provides a means of voltage shifting. The collector of the transistor 132 is connected directly to the terminal 104 and the emitter terminal is referenced through a resistor 133 through the second input line 33. The emitter of the transistor 132 is also connected to an inverting input 134 of a voltage comparator 135. A non-inverting input 136 of the comparator 135 is referenced to the second input line 33 to a resistor 137 and is also referenced to the terminal 104 through another resistor 138. The resistors 137, 138 provide a voltage reference for the non-inverting input 136. An output 139 of the comparator 135 is connected through diode 140 to the lead 108. The diode 140 is poled such that the cathode terminal thereof is connected to the output 139.

The operation of the current threshold detecting means will now be considered. Current through the current sensing means, resistor 129, and through the commutating diode 51 cause the light emitting diode 130 to emit illumination. The adjustable resistor 131 provides adjustment of the intensity of the illumination from the diode 130. Illumination of the photosensitive transistor 132 causes conduction of current through the transistor 132, with higher levels of illumination causing larger currents to be conducted in the transistor 132. Because the inputs 134, 136 of the comparator 135 are both of quite high impedance, current through the transistor 132 flows through the resistor 133 thereby establishing an analog voltage at the inverting input 134. The analog voltage is related in magnitude to the level of current through the commutating diode 51. When the current through the commutating diode 51 becomes sufficiently high, the analog voltage at the inverting input 134 will exceed the reference voltage at the noninverting input 136 thereby causing the output 139 of voltage comparator 135 to assume a low voltage condition. The diode 140 which was previously reverse biassed now becomes forward biassed and diverts bias current away from the transistor 110. The current threshold detecting means will thus be able to override the output of the free-running multivibrator circuit, thereby providing a pulse-width modulated control means for controlling the on and off conductive states of the series-pass transistor 44.

It will be appreciated that the ballasting circuit in FIG. 5 will use a starting circuit between the junction 50 and the second input line 33 for striking an arc in a gaseous discharge lamp such that the ballasting circuit of FIG. 5 will then operate in its current-regulated output mode.

Figure 7:
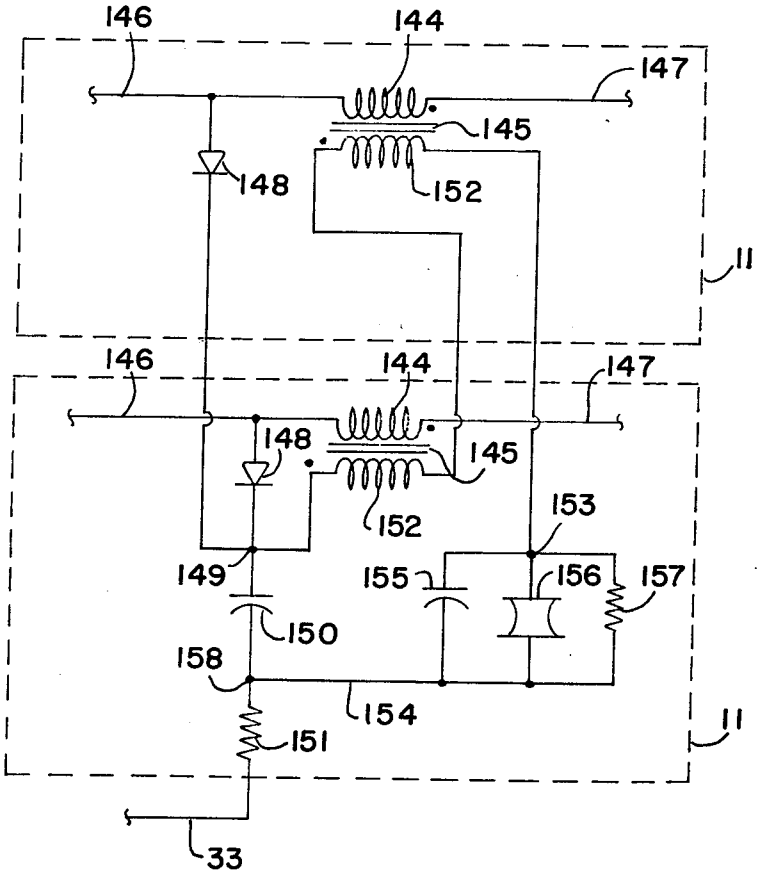
FIG. 7 is a schematic diagram illustrating use of a single starting circuit in conjunction with a plurality of ballasting circuits.

Turning to FIG. 7, there is disclosed a schematic diagram wherein a single starting pulse circuit is capable of sensing a nonfunctioning lamp on any one of a plurality of ballasting circuits and independently starting the nonfunctioning lamp. The secondary winding 144 of a pulse transformer 145 is provided in series with the output of each of a plurality of ballasting circuits. In each of the circuits, a lead 146 connects one terminal of the secondary winding 144 to a junction 150 as in FIGS. 3, 4 and 5, while another lead 147 connects to other terminal of the secondary winding 144 to the output terminal 34 as in FIGS. 3, 4 and 5. A diode 148 is provided for each of the plurality of the circuits 11 with an anode of each of the diodes 148 connected to the leads 146. The cathode terminals of all diodes 148 are connected together at a junction 149, such that the diodes are wired in a logic "or" configuration. An energy storage capacitor 150 is referenced through a resistor 151 to the second input line 33. From the junction 149, each primary winding 152 of the plurality of pulse transformers 145 is wired in series to a junction 153. Polarity markings must be observed as indicated in FIG. 7 when wiring the primary windings 152 in series. Connected in parallel between the junction 153 and a lead 154 are a capacitor 155, a spark gap 156, and a resistor 157. The lead 154 is also connected to a junction 158 between the capacitor 150 and the resistor 151.

When a nonenergized lamp is connected to any one of the ballasting and starting circuits, the potential on one of the leads 146 will rise toward the potential present across the inputs 32, 33 of the ballasting circuit. The energy storage capacitor 150 will begin charging toward the potentials supplied by one of the diodes 148, as determined by the voltage dividing resistors 151, 157. The potential at the leads 146 of other ballasting circuits with energized lamps wil remain unaffected because the diodes 138 associated with those circuits will be reverse biassed. When the voltage across the energy storage capacitor reaches the voltage threshold point of the spark gap 156, an arc is established in the spark gap 156 and capacitor 155 provides sufficient current when the arc is first established in the spark gap 156 to ensure that the spark gap 156 assumes a low impedance mode. The energy storage capacitor 150 is thereupon discharged through each of the primary windings 152 of the pulse transformers 145 through the spark gap 156. Because the ballasting circuit with the nonionized lamp will exhibit a much greater impedance than those circuits with ionized lamps, most of the energy in the capacitor 150 will be presented to the pulse transformer 145 which is associated with the nonionized lamp. Thus, the starting circuit is capable of sensing which one of a plurality of ballasting circuits has a nonionized lamp and is further capable of delivering a starting pulse of sufficient magnitude and duration to ionize said lamp.

Figure 6:
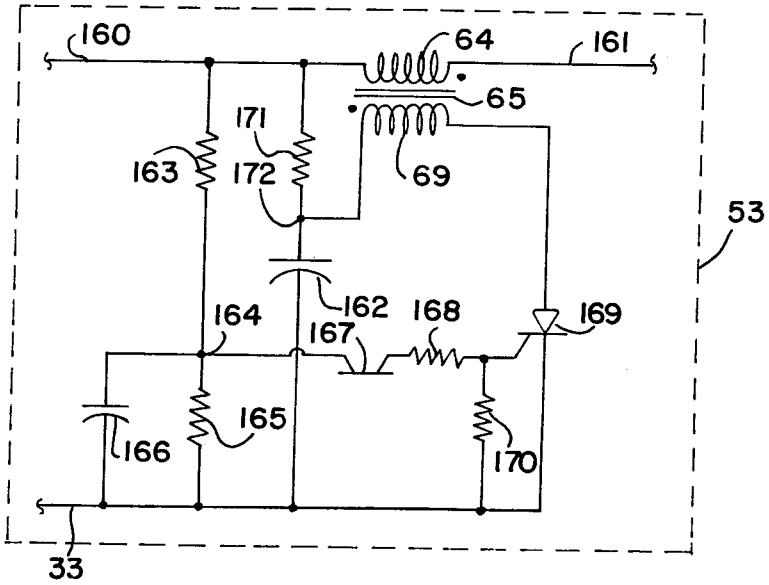
FIG. 6 is a schematic circuit diagram illustrating an alternate embodiment of a starting circuit.

Another embodiment of the starting circuit 53 of FIGS. 2 and 3 is illustrated in FIG. 6. Similar to FIGS. 2 and 3, a secondary winding 64 of a pulse transformer 65 is connected between the junction 50 and the output terminal 34 by leads 160 and 161, respectively. A voltage dividing resistor 163 is connected between the lead 160 and a junction 164 which is in turn referenced to the second input lead 33 by another voltage dividing resistor 165. A capacitor 166 connected between the junction 164 and the second input lead 33 filters electrical noise at the junction 164. A voltage level detecting means, such as a diac 167, monitors the voltage level at the junction 164. The diac 167 is connected in series with a resistor 168 between the junction 164 and the gate terminal of an SCR 169. The resistor 168 limits the amount of current which may be received by the gate terminal of the SCR 169 when the voltage threshold level of the diac 167 is exceeded. Another resistor 170 is connected between the gate terminal of the SCR 169 and the second input line 33 for passing any leakage currents from the diac 167.

The energy storage capacitor 162 is connected in series with a resistor 171 to the lead 160. One end of the primary winding 69 of the pulse transformer 65 is connected to a junction 172 between the capacitor 162 and resistor 171. The other end of the primary winding 69 is connected to the anode terminal of the SCR 169. The cathode terminal of the SCR 169 is referenced to the second input line 33.

The line 160 will rise to a potential nearly equal to the D.C. supply voltage to the inputs 32, 33 of the ballasting circuit, as previously discussed with the starting circuits in FIGS. 2 and 3. When this occurs, the voltage at the junction 164 will rise slowly causing the threshold voltage of the diac 167 to be exceeded. The diac 167 will thereupon become conductive and discharge the potential across the capacitor 166 into the gate terminal of the SCR 169, thereby firing the SCR 169. The SCR 169 will in turn discharge the energy storage capacitor 162 through the primary winding 69 of the pulse transformer 65, thereby generating a pulse on the secondary winding 64 of sufficient magnitude and duration to strike an arc in the lamp. The resistor 171 is of a high resistive value such that when the SCR 169 has discharged the capacitor 162 to a low level, the resistor 171 will not supply sufficient holding current to keep the SCR 169 in a conductive state. The SCR 169 will then cease conduction and the capacitor 162 will again begin to charge toward the potential on the line 160 through the resistor 171. The starting circuit 53 thus resets itself and continues to monitor the potential at the lead 160. Should some malfunction or other problem arise, the starting circuit 53 is prepared to restart the lamp.

For proper operation of the circuity disclosed above and in the various drawings, selection and design of the various magnetic components is important. For example, if the switching transistor 44 is to operate near the 20 kiloHertz range, powdered ferrite cores are preferred. The magnetic components may utilize pairs of "E" cores with the legs of the pairs of "E" cores butted together. Air gaps of various widths are also employed. For example, the inductor 48 typically has 400 turns of #28 copper wire wound on a pair of "E" cores with a 0.020 inch air gap between the legs of the "E" cores. Suitable cores are commercially available from Ferroxcube Corp., Saugerties, N.Y. 12477 as part number 782E272-3E2A.

Similarly, the transformer 75 has a primary winding 77 of 134 turns of #39 wire and a secondary winding of 8 turns of #29 wire with a 0.005 inch air gap between a pair of "E" cores of part number 206F440-3E2A (Ferroxcube). The pulse transformers 65, 145 have a primary winding 69, 152 of 9 turns of #23 wire and a secondary winding 64, 144, of 200 turns of #26 wire with a 0.010 inch air gap between pairs of "E" cores of part number 782E272-3E2A (Ferroxcube).

It will be understood that various changes and modifications can be made without departing from the spirit of the invention as defined in the following claims, and equivalents thereof.

We claim:

1. Direct current ballasting and starting circuitry for operating a gaseous discharge lamp on direct current therefrom; said circuitry comprising:

a pair of input lines for attachment to a source of direct current voltage;

a pair of output terminals connectable to said lamp;

switching means in series in one of said pair of input lines, said switching means alternatively switchable between on and off conductive states for periodically supplying pulses of energy from said source of direct current voltage;

current sensing means for limiting the maximum current conducted by said switching means during the conductive state thereof;

filter means in series with said switching means for smoothing the pulses of energy delivered by said switching means into direct current with a comparatively small alternating current component;

starting means in series in connection between said filter means and one of said pair of output terminals, said starting means responsive to a non-energized state of said lamp to provide a starting voltage pulse at an output terminal of a said circuitry of sufficient magnitude and duration to initiate ionization in said lamp, said starting means permitting uninterferred passage of current from said filter means to said output terminal after initiation of ionization in said lamp; and control means momentarily excited by said starting voltage pulse and thereafter interacting with said switching means to control the conductive states of said switching means.

2. The direct current ballasting and starting circuitry as in claim 1 wherein said switching means comprises a transistor with a collector terminal and an emitter terminal, said terminals connected in series in one of a pair of said input lines, and a base terminal connected to said control means.

3. The direct current ballasting and starting circuitry as in claim 2 wherein said current sensing means comprises a resistor in series with the emitter terminal of said transistor and a zener diode connected between the base terminal of the transistor and another terminal of said resistor opposite to the terminal connected to the transistor, said zener diode poled to bypass base current drive from said transistor when the sum of the potentials generated across said resistor and across a base-emitter junction of said transistor exceed the zener breakdown voltage of said zener diode, thereby limiting the maximum current conductible by said transistor during the conductive states thereof.

4. The direct current ballasting and starting circuitry as in claim 3 wherein another diode is connected in series with said zener diode to temperature compensate for variations in the potential across the base-emitter junction of said transistor.

5. The direct current ballasting and starting circuitry as in claim 1 wherein said current sensing means is in series connection with said switching means, and said filtering means comprises inductive means in series connection between said current sensing means and said starting means; a capacitor, with one terminal connected to said inductive means on the starting means side thereof and with another terminal connected to the second of said pair of input lines, for filtering current through said inductive means; and a commutating diode, with one terminal connected to said inductive means on the current limiting said thereof and with the other terminal connected to the second of said pair of input lines, for maintaining continuity of current of said inductive means during nonconductive states of said switching means.

6. The direct current ballasting and starting circuitry as claimed in claim 1 wherein said control means comprises an oscillator momentarily excited by the starting voltage pulse and thereafter interacting with said switching means to remain in an oscillatory condition, and an output signal of said oscillator adapted to control one of the conductive states of said switching means, said switching means operating at the natural resonant frequency of said oscillator.

7. The direct current ballasting and starting circuitry as claimed in claim 6 wherein said oscillator includes phase-shifting means for shifting phase of said output signal of said oscillator to cause said switching means to have nominal duty cycle of approximately 70 percent.

8. The direct current ballasting and starting circuitry as claimed in claim 2 wherein said control means comprises an oscillator with a resonant tank circuit including a primary winding of a transformer and a capacitor connected in series, one end of said tank circuit connected to the emitter terminal of said transistor, another terminal of said tank circuit connected to a second of said pair of input lines; amplification means connected between the capacitor and the primary winding of said tank circuit, and between said output terminal for momentarily exciting said tank circuit with said starting voltage pulse; and a secondary winding of said transformer in series connection with a phase-shifting network across the base-emitter junction of said series-pass transistor for controlling base drive to said transistor and for resonant interaction between said transistor and said tank circuit.

9. The direct current ballasting and starting circuitry as claimed in claim 1 wherein said starting means comprises a transformer with a secondary winding thereof connected in series between said filter means and one of said pair of output terminals, a primary winding with an energy storage means at one terminal thereof, threshold sensitive means connected to another end of said primary winding and to said energy storage means to form a loop with said primary winding, said threshold sensitive means being rendered conductive when the voltage between said output terminal and the second of said input lines is indicative of a nonionized state of said lamp, said threshold sensitive means thereupon discharging said energy storage means through the primary winding of said transformer to create a starting voltage pulse in said secondary winding of sufficient magnitude and duration to initiate ionization in said lamp.

10. The direct current ballasting and starting circuitry as claimed in claim 9 wherein said energy storage means comprises a first capacitor and said threshold sensitive means comprises a gaseous spark gap, with a second capacitor in parallel therewith to provide sufficient initial current through said spark gap to insure that said spark gap operates in a low impedance mode for rapidly discharging said first capacitor through said primary winding.

11. Direct current ballasting and starting circuitry for operating a gaseous discharge lamp on direct current therefrom; said circuitry comprising:

a pair of input lines for attachment to a source of direct current voltage;

at least one output terminal connectable to said lamp;

switching means in series with one of said pair of input lines, said switching means alternatively switchable between on and off conductive states for periodically supplying pulses of energy from the source of direct current voltage;

current sensing means in series with said switching means for limiting the current conducted by said switching means;

filter means in series with said switching means for smoothing the pulses of energy delivered by said switching means to direct current with a comparatively small alternating current component;

starting means in series connection between said filter means and said output terminal, said starting means responsive to a nonionized state of said lamp to provide a voltage pulse at said output terminal of said circuitry of sufficient magnitude and duration to initiate ionization in said lamp, said starting means permitting passage of current from said filter means to said output terminal after initiation of ionization in said lamp;

control means comprising a resonant circuit including a pair of primary windings of a resonant transformer in series connection between said current sensing means and said filter means, and a capacitor connected between a second of said pair of input lines and said pair of primary windings, and a secondary winding of said resonant transformer adapted to control the conductive state of said switching means.

12. The direct current ballasting and starting circuitry as claimed in claim 11 wherein said switching means comprises a series-pass transistor with a collector terminal and an emitter terminal in series in one of a pair of said input lines and a base terminal connected to said control means, and said secondary winding of said resonant transformer connected in series with a resistor across the base-emitter junction of said series-pass transistor.

13. A starting circuit for initiating ionization in a plurality of gaseous discharge lamps; each of said lamps operated from a separate direct current ballasting circuit, said circuitry having an output line adapted for connection to one terminal of said lamps, said starting circuit comprising:

a voltage responsive means for detecting a voltage above a predetermined threshold;

energy storage means, one terminal thereof connected to said voltage responsive means;

a plurality of diodes, one diode connected from each ballasting circuit output line to another terminal of said energy storage means, each diode poled to enable charging of said energy storage means from any ballasting circuit output line;

a plurality of pulse transformers, one for each direct current ballasting circuit, each of said pulse transformers having a primary and a secondary winding;

each direct current ballasting circuit having a primary winding of a pulse transformer in series connection in said output line thereof;

a secondary winding of each of said plurality of pulse transformers in series connection between another terminal of the energy storage means and the voltage responsive means, whereby an abnormally high voltage appearing at any output line, which is indicative of a nonionized lamp on that ballasting circuit, will cause a voltage appearing at said energy storage means to exceed the threshold of said voltage responsive means thereby discharging said energy storage means through the secondary winding of each of said plurality of pulse transformers to generate a starting voltage pulse in the primary winding of the ballasting circuit with the nonionized lamp.

14. Direct current ballasting and starting circuitry for operating a gaseous discharge lamp on direct current therefrom, said circuitry comprising:

a pair of input lines for attachment to a source of direct current voltage; at least one output terminal connectable to said lamp;

switching means in series with one of said pair of input lines, said switching means alternatively switchable between on and off conductive states for periodically supplying pulses of energy from said source of direct current voltage;

inductive filter means in series with said switching means for smoothing the pulses of energy delivered by said switching means into a direct current with a comparatively small alternating current component;

starting means in series connection between said inductive filter means and said output terminal, said starting means reponsive to a nonionized state of said lamp to provide a voltage pulse at said output terminal of sufficient magnitude and duration to initiate ionization of said lamp, said starting means permitting passage of current from said filter means to an output terminal after initiation of ionization of said lamp;

a commutating diode with one end connected between said switching means and said inductive filter means and another end connected to the second of said pair of input lines, said commutating diode being conductive during nonconductive states of said switching means to maintain continuity of current through said inductive filter means;

drive means for rendering said switching means periodically conductive;

current threshold detecting means for detecting whether the current through said commutating diode exceeds a predetermined threshold level, said current threshold detecting means further adapted to inhibit said drive means as long as the current through said commutating diode exceeds said threshold level, whereby said current threshold detecting means pulse-width modulates said drive means and said switch means to regulate the current delivered by said ballasting circuitry to said lamp.

15. The direct current ballasting and starting circuitry as claimed in claim 14 wherein said drive means comprises a free-running multivibrator.

16. The direct current ballasting and starting circuitry as claimed in claim 15 wherein said free-running multivibrator has a duty cycle of approximately 70 percent.

17. The direct current ballasting and starting circuitry as claimed in claim 15 wherein said current threshold detecting means comprises resistive means in series with said commutating diode to sense the current level therethrough; a reference voltage; voltage shifting means for providing a voltage analog related magnitude to the level of current through said commutating diode; and comparator means for comparing the reference voltage to the analog voltage, said comparator means having an output adapted to inhibit said drive means whenever said analog voltage exceeds said reference voltage.

18. The direct current ballasting and starting circuitry as claimed in claim 17 wherein said voltage shifting means comprises a light emitting diode with a portion of the potential generated across said resistive means applied thereto; and a photosensitive transistor in proximity to said light emitting diode whereby illumination from said light emitting diode regulates current conduction through said photosensitive transistors; and a resistor in series with said photosensitive transistor whereby said analog voltage is generated at a junction between said photosensitive transistor and said resistor and said analog voltage is related in magnitude to the current level through said commutating diode.

* * * * *